United States Patent [19]

Kutz et al.

[11] 4,078,403

[45] Mar. 14, 1978

[54] APPARATUS FOR THE LINGERING TREATMENT OF TEXTILE WEBS

[76] Inventors: Johannes Kutz, Schulstr. 6, St. Tonis b. Krefeld; Wolfgang Kurschatke, An der Pappel 28; Kurt Quoos, Bismarckstr. 74, both of D-4150 Krefeld, all of Germany

[21] Appl. No.: 688,984

[22] Filed: May 24, 1976

[30] Foreign Application Priority Data

May 31, 1975 Germany ..... 2524249

[51] Int. Cl.[2] ..... D06B 3/02

[52] U.S. Cl. ..... 68/43; 68/158; 68/177

[58] Field of Search ..... 68/38, 39, 40, 43, 45, 68/53, 54, 158, 177, 175; 26/19-23

[56] References Cited

U.S. PATENT DOCUMENTS

| | | | |
|---|---|---|---|
| 1,832,377 | 11/1931 | Gessner | 68/43 X |
| 3,092,989 | 6/1963 | Ludwig et al. | 68/158 |
| 3,580,015 | 5/1971 | Horie et al. | 68/53 |
| 3,700,404 | 10/1972 | Janisch et al. | 68/43 X |

FOREIGN PATENT DOCUMENTS

| | | | |
|---|---|---|---|
| 500,216 | 11/1954 | Italy | 68/177 |
| 24,709 | 8/1970 | Japan | 68/177 |
| 1,144,782 | 3/1969 | United Kingdom | 68/177 |

*Primary Examiner*—Philip R. Coe

*Attorney, Agent, or Firm*—Kenyon & Kenyon, Reilly, Carr & Chapin

[57] ABSTRACT

Apparatus for treating textile webs in a treatment fluid such that the material lingers in the treatment fluid for a period of time, in which a support bottom in the form of a trough extending transverse to the textile web and a swinging or oscillating member, having the same curvature as the trough, freely suspended at an eccentric and rotated about an axis parallel to the trough with the direction of the rotation the same as that of the travel direction of the textile web through the trough, form a channel at the beginning of which the textile web is placed in transversal folds and at the end of which the web is drawn off, all of the channel being situated below the fluid level thereby resulting in an improved rinsing action as the web is moved through the channel with the oscillating member aiding in both the rinsing action and in moving the web of material through the channel.

9 Claims, 3 Drawing Figures

APPARATUS FOR THE LINGERING TREATMENT OF TEXTILE WEBS

BACKGROUND OF THE INVENTION

This invention relates to apparatus for the lingering treatment of textile webs in general and more particularly to an improved apparatus of this nature.

Various designs of washing equipment for textile webs are known in which the web is placed in the apparatus in loose transversal folds and compressed between oscillating mechanical elements. The compression obtained through the oscillation results in an action on the textile web which is comparable to the process of washing by hand. Thorough rinsing is achieved and, in addition, a desirable fulling or densification effect takes place in many cases. As the web of material travels through the apparatus with loose folds, it has a large content of material which means that its dwelling time within the washing apparatus is such as to insure an adequate washing effect.

One type of apparatus of this nature is disclosed in British Pat. No. 439,305. In the disclosed apparatus the goods are placed into the top of a tank filled with a treatment fluid. The tank has a supporting bottom which descends at the entrance zone in the manner of a chute and then merges into a horizontal part. The goods are acted upon from the top by means of a vibrating member in the form of a plate which extends substantially over the horizontal part but also covers a portion of the chute and is curved upward in this region to correspond to the shape of the chute. In the treatment zone, the vibrating member and the support bottom are perforated. The vibrating member is disposed for vertical motion and is set into rectilinear vibration in a direction toward the support bottom through the use of a crank mechanism. The goods move downward by means of the chute and, in a folded condition, through the channel formed between the vibrating member and the support bottom. A similar design is disclosed in German Pat. No. 912,447. In this device the vibrations are generated by suitable vibrators rather than by a crank mechanism.

It is a primary disadvantage of this known apparatus that the transport of the web through the channel and the folding takes place during treatment only under the influence of gravity causing the goods to slide down the chute and the back pressure resulting from the folded goods in the channel. Particularly in the horizontal region the conveyor action is often insufficient so that the channel becomes partially empty when the material is drawn off while at the same time material piles up at a point further back. In many cases, non-uniform travel of the material is thus unavoidable.

In view of these deficiencies with the prior art apparatus, it is the object of the present invention to provide an improved apparatus of this general type in which uniform travel of the material through the channel is obtained.

SUMMARY OF THE INVENTION

The present invention solves this problem by providing a support bottom which forms a trough extending transverse to the textile web and by having an oscillating or swinging member which is curved in similar manner. The swinging or oscillating member is supported, freely suspended, at an eccentric which is rotated about an axis parallel to the trough axis and with a direction of rotation which is the same as the travel direction of the textile web through the trough.

The channel in which the treatment of the textile web takes place forms, in a manner of speaking, a low point in the travel direction of the textile web. At the entrance of the channel the textile web is placed on the beginning portion of the support bottom where it is steep and in the process either slides by itself or aided by transport devices to produce a folded condition.

It has been discovered that the embodiment of the present invention using a swinging member rotating eccentrically produces a conveyor effect which transports the textile web through the channel, essentially retaining the folded condition. It can even impart to the textile web a pleating corresponding to the frequency of motion of the eccentric drive. The conveyor effect comes about because of the fact that, with the arrangement of the present invention, the swinging member moves not just in a rectilinear manner perpendicular to the support bottom but also, because of the motion of the eccentric, has components in the travel direction. These result in a kind of rocking motion and cause the textile web to be carried along therewith. The rocking motion takes places in such a manner that, when the swinging member approaches the support bottom, there is at the same time a component of motion in the direction of travel of the web which tends to carry it along with the swinging member. Because of the presence of the textile web in the channel in a folded condition, there is obtained, despite the usual high material velocity of the web in the straight condition before and after the apparatus, a sufficiently long dwelling time causing every portion of the web to be subjected to the treatment. An oscillating drive utilizing an eccentric is also simple, effective and of great advantage from an energy point of view so that a considerable washing effect can be imparted to the textile web.

In the preferred embodiment of the invention, the vertical longitudinal section of the surface of the support bottom defining the channel and of the swinging member is a section of a circle. The beginning and end of the channel are advantageously at the same height, a height corresponding to the fluid level. It has been found that it is sufficient in many cases to let the entering material bunch up on the steep inital part of the support body in order to obtain a suitably loose folded condition of the textile web. However, for material which will not readily lay in folds, it is advisable to provide an upsetting device which pushes the textile web into the channel at the entrance to the channel.

Such an upsetting device can be implemented, for example, through the use of a pair of grooved rolls or bars disposed ahead of the entrance of the channel. The bars are arranged parallel to the travel direction and extend from grooved rollers to the entrance of the channel engaging with the grooved rollers on both sides of the textile web and thus forming a cage through which the textile web, upset by the grooved rollers, can be pushed into the channel.

In some cases, certain difficult materials will resist being conveyed through the channel. In such cases means to assist in their transport should be provided. A type of device which may be used for this purpose is a simultaneously advancing fluid permeable belt carrying the textile web and which is led through the channel lying on the trough. Such a device provides an additional propelling effect to carry along the textile web through the channel.

The swinging member is designed to be permeable to the treatment fluid in order to reduce flow resistance during its motion through the treatment fluid. In other words, it may be designed as a screen or perforated plate. The support bottom may be solid, in some cases itself forming the bottom of the treatment fluid tank, or it may be permeable in which case it is then arranged in a tank filled with treatment fluid at a distance from the bottom of the latter.

DETAILED DESCRIPTION OF THE PREFERRED EMBODIMENT

Figure 1:
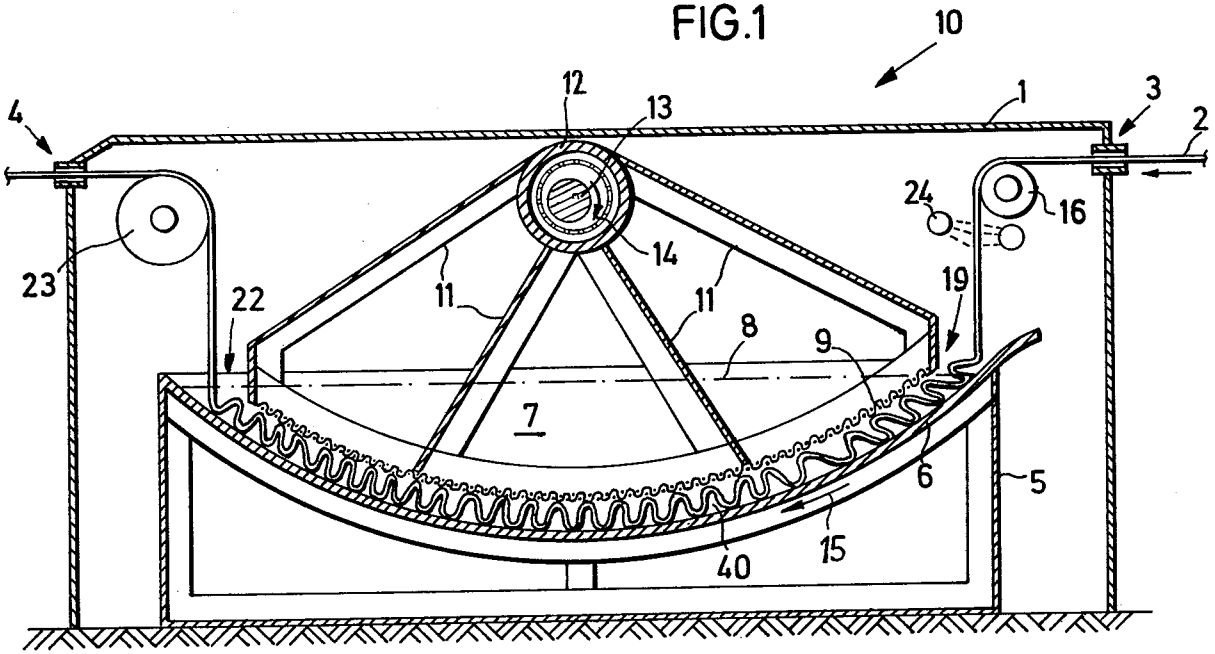
FIG. 1 is a vertical longitudinal cross section through apparatus according to the present invention.

FIG. 1 illustrates the basic apparatus, designated generally as 10, of the present invention. As illustrated, it includes a housing 1 into which a textile web 2 is fed at an entrance 3 with the web drawn off from the housing at an exit 4.

Within the housing 1 is located a structure 5 which includes or carries a support bottom 6 which forms a trough extending transverse to the forward travel direction of the web, i.e. it extends perpendicular to the plane of drawing of FIG. 1. The support bottom is formed by a closed, bent plate and has a lateral side walls so that a tub-like tank 7 is formed. The tank 7 is filled with a treatment fluid having a level 8. Above the support bottom 6 and at a distance therefrom is a swinging member 9 having a curvature matching that of the support bottom 6. Swinging member 9 consists of a grid material causing it to be permeable to the treatment fluid. In the illustrated embodiment, the vertical longitudinal cross sections of the boundary surfaces of the support bottom 6 and the swinging member 9 which face each other are sections of a circle. As is evident from the figure, the sections or segments of a circle which the support bottom and swinging member 9 form subtends less than 180°. The support bottom 6 and the swinging member 9 form therebetween a channel 40 which, corresponding to the shape of the trough, first drops downward in the travel direction of the web at the right and then rises again toward the left.

At the entrance 3 of the apparatus 10 the textile web is run over a deflection roller 16 onto the steep initial part of the support bottom and in the process is laid in folds which slide into the beginning 19 of the channel 40. Spray tubes 24 moisten the textile web heavily on one or both sides before it reaches the support bottom 6 in order to aid its readiness to form folds. At the exit 22 of the channel 40, the textile web runs over a retracting roller 23 and is thereby straightened out again.

The swinging member 9 is connected to a hollow shaft 12 by means of struts 11. The hollow shaft 12 is disposed above the channel 40 and is supported on an eccentric shaft 13 which is rotated in appropriate bearings in the housing 1. Rotation is in the direction of the arrow 14, a direction corresponding to the travel direction 15 of the web 2 as it moves through the channel 40. The swinging member 9 is thus a rigid cage supported on the hollow shaft 12 directly on the eccentric member without the interposition of linkages or the like.

As the eccentric shaft 13 rotates, the swinging member 9 freely suspended therefrom executes a slight rocking motion about the eccentric shaft. This rocking motion has components directed toward the support bottom 6 as well as components in the travel direction 15. In addition to the fact that this motion compresses and kneads the textile web present in the channel 40 in transversal folds again and again, thereby obtaining a good rinsing and washing effect, it also results in a transport effect in the travel direction 15 causing the textile web 2 to be carried along in the channel 40. This prevents bunching up in one area of the channel and pulling straight in another area.

Figure 2:
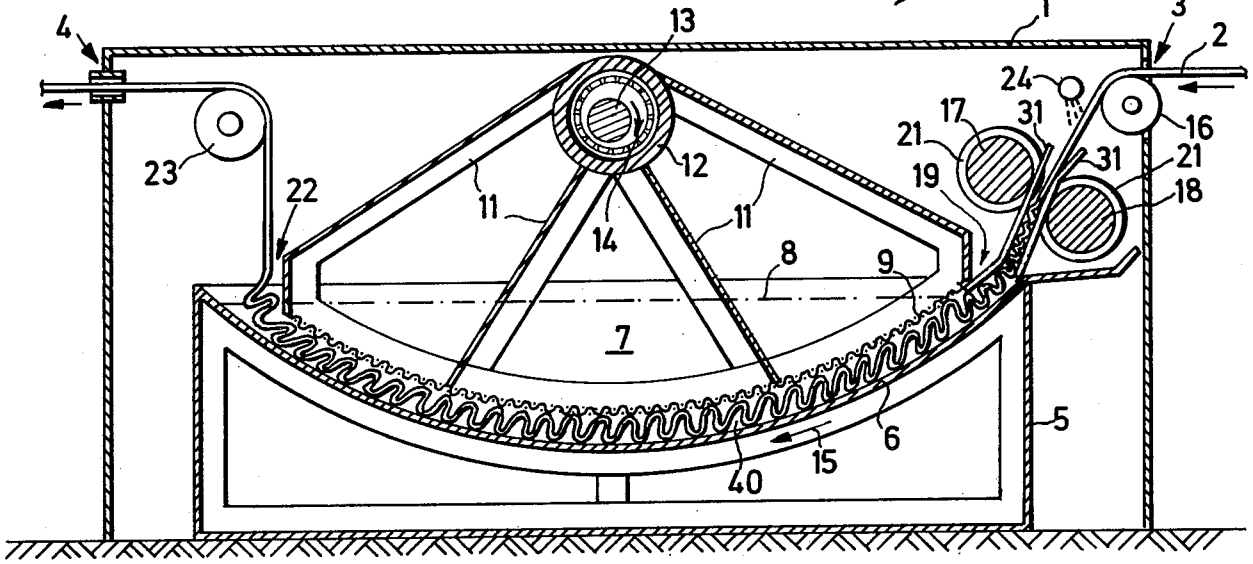
FIG. 2 is a similar view through apparatus according to the present invention preceeded by an upsetting device.
Figure 3:
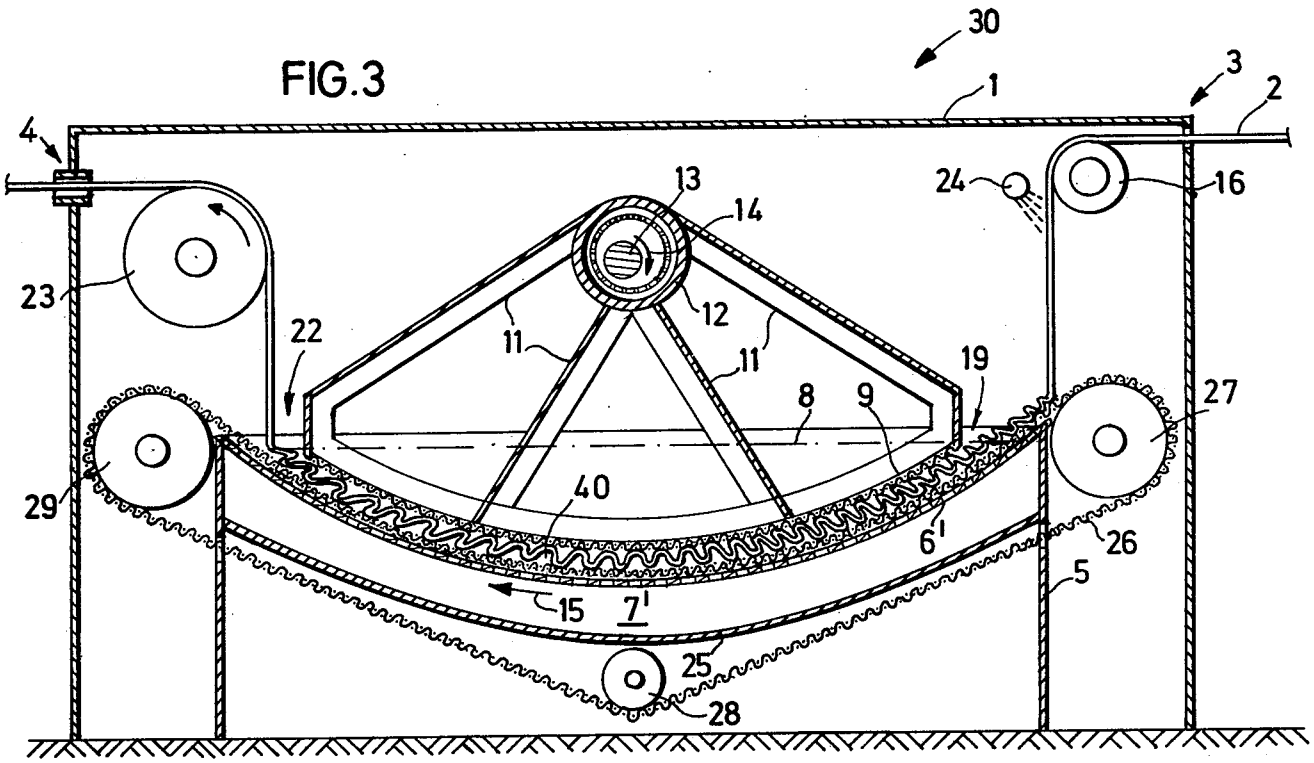
FIG. 3 is a similar view through apparatus according to the present invention having a screen belt.

FIGS. 2 and 3 illustrate additional embodiments of the present invention. Elements which are the same as those in FIG. 1 are given the same reference numerals and will not be explained again in detail.

In the embodiment of FIG. 2 the apparatus of the present invention is again closed on its bottom by the support bottom 6 which forms a tub-like tank 7 for the treatment fluid. However, in this embodiment the textile web 2 does not run directly onto the support bottom 6, but first runs through an additional upsetting device having grooved rollers 17 and 18. The textile web enters at the entrance 3 of the housing 1 over a deflection roller 16, is seized by the grooved rollers 17 and 18 and pushed into the channel 40 at the entrance 19. On both sides of the textile web 2, bars 31 extending from the grooved rollers 17 and 18 up to the entrance 19 of the channel 40 are provided. The bars extend through the gap between the grooves 21 of the grooved rollers 17 and 18. Thus, the bars 31 form a cage in which the textile web 2, upset to form folds, is guided into the channel 40.

In the apparatus of FIG. 3, the support bottom 6' is not closed. Instead, it is disposed a distance above a closed bottom 25 which, with the sides, forms a treatment tank 7'. In this embodiment, the support bottom 6' is perforated, i.e. it is made of a net-like or screen like material. With this embodiment, there is access of the treatment fluid to the channel 40 from both sides.

Furthermore, in this embodiment a screen belt 26 which lies in the trough on the support bottom 6' is provided. The screen belt 26 is led over and can be driven by the deflection rollers 27, 28 and 29. This moving screen belt 26 assists in the movement of the textile web 2 through the channel 40. Because of the permeability of the screen belt 26, the access of the treatment fluid to the textile web is not impaired.

Other embodiments combining various features illustrated in FIGS. 1, 2 and 3 may also be constructed. For example, in certain applications it is possible to use a screen belt 26 with an impermeable support bottom such as the support bottom 6 of FIGS. 1 and 2. Such is particularly useful where compression and fulling action is more important than rinsing. In addition, the permeable elements such as the support bottom 6', the swinging member 9 and also the belt 26 can use grid like structures consisting of parallel rods in addition to the use of screens or other perforated materials. In the case of the support bottom 6', the rods would have to be parallel to the travel direction 15 and, in the case of the belt 26, transverse thereto.

In the embodiment of FIG. 3 no upsetting device is provided. Instead, the textile web 2 runs directly from the deflection roller 16 onto the steep part of the support bottom 6 at the beginning 19 of the channel 40 and folds are formed automatically. The conveyor action of the swinging member 9 in conjunction with the conveyor action of the simultaneously advancing screen belt 26 is sufficient to carry even materials which are difficult to transport through the channel 40.

We claim:

1. In apparatus for the lingering treatment of textile webs during continuous travel through a treatment fluid, such as washing apparatus, which comprises a support bottom for the textile web disposed in a tank filled with treatment fluid the support bottom extending in the travel direction; means for placing the textile web in transversal folds on the beginning of the support bottom; means for drawing the textile web from the end of the support bottom, an oscillating member disposed above the support bottom having a shape matched to the shape of the support bottom; and means driving said oscillating member in an oscillating manner with respect to the support bottom, the oscillating member and support bottom forming therebetween a channel disposed below the fluid level through which the textile web can be moved simultaneously with the oscillating movement of said oscillating member, the improvement comprising:

(a) the support bottom being in the form of a curved trough extending transverse to the textile web and having a vertical longitudinal cross section which is a sector of a circle;

(b) the means driving comprising an eccentric shaft disposed for rotation about an axis parallel to the axis of the circle of which the vertical cross section of said trough is a sector adapted for rotation in the direction of travel of said web through said channel; and (c) the oscillating member comprising a member having a vertical longitudinal cross section which is a sector of a circle with a curvature matching that of the trough, the sector of the circle of the vertical longitudinal cross section of said curved trough and of said oscillating member subtending less than 180° and means supporting said member such that it is freely suspended on said eccentric shaft.

2. Apparatus according to claim 1 wherein the beginning and end of said channel are at approximately the same height.

3. Apparatus according to claim 1 and further including an upsetting device at the entrance of said channel, said upsetting device comprising a pair of grooved rollers disposed ahead of the entrance of said channel, the grooves of said grooved rollers engaging on both sides of said textile web; and bars parallel to the direction of travel of said web extending from said grooved rolls to the entrance of said channel, thereby forming a cage through which the textile web, upset by the grooved rollers, can be pushed into said channel.

4. Apparatus according to claim 1 and further including a belt, permeable to liquid, disposed within said channel lying on said support bottom; and means for directing said belt so that it advances along with said web being led over said support bottom.

5. Apparatus according to claim 4 and further including means for driving said belt in the direction of travel of said web.

6. Apparatus according to claim 1 wherein said support bottom is permeable to liquid.

7. Apparatus according to claim 6 wherein said support bottom is disposed a distance from the bottom of said treatment fluid tank.

8. Apparatus according to claim 1 wherein said support bottom is solid and forms the bottom of said treatment fluid tank.

9. The improvement according to claim 1 wherein said member having a curvature comprises a grid material and said means supporting said member comprise a hollow shaft supported on said eccentric shaft and a plurality of struts connecting said grid material to said hollow shaft.

* * * * *